United States Patent [19]

Stuck

[11] 4,090,308

[45] May 23, 1978

[54] METHOD AND APPARATUS FOR SIGNALLING CONCENTRATION OF AIR CONVEYED IONIZABLE FOREIGN MATTER

[75] Inventor: Robert M. Stuck, Charlotte, N.C.

[73] Assignee: Aero-Dyne Manufacturing, Inc., Charlotte, N.C.

[21] Appl. No.: 601,459

[22] Filed: Aug. 4, 1975

[51] Int. Cl.[2] ..... F26B 3/04

[52] U.S. Cl. ..... 34/32; 34/43; 34/79; 34/89; 55/18; 55/212; 324/33; 324/71 R

[58] Field of Search ..... 23/277 C; 423/215.5, 423/210; 110/8 A; 340/237 R, 237 S; 34/32, 43, 79, 89; 324/33, 71 R, 62, 65 R; 432/72; 55/18, 212; 98/115 K; 73/27 R, 29, 30

[56] References Cited

U.S. PATENT DOCUMENTS

| | | | |
|---|---|---|---|
| 3,693,009 | 9/1972 | Sasaki | 340/237 S |
| 3,781,838 | 12/1973 | Primmer | 340/237 S |
| 3,805,259 | 4/1974 | Inoue | 340/237 S |
| 3,886,854 | 6/1975 | Culpepper, Jr. | 23/277 C |
| 3,932,137 | 1/1976 | Culpepper, Jr. | 23/277 C |
| 3,942,264 | 3/1976 | Zenker | 23/277 C |
| 3,949,390 | 4/1976 | Rayl et al. | 340/237 R |

*Primary Examiner*—John J. Camby
*Assistant Examiner*—Larry I. Schwartz
*Attorney, Agent, or Firm*—Bell, Seltzer, Park & Gibson

[57] ABSTRACT

A method and apparatus by which the degree of concentration of ionizable foreign matter conveyed by an entraining air flow is detected and signalled and in which at least a portion of an air flow and matter conveyed thereby is passed through an ionization detector spark gap while a continuous arcing electrical discharge is maintained across the gap. The electrical conductivity of the discharge is monitored, so that fluctuations in the concentration of conveyed matter are indicated by fluctuations in the monitored discharge conductivity.

17 Claims, 3 Drawing Figures

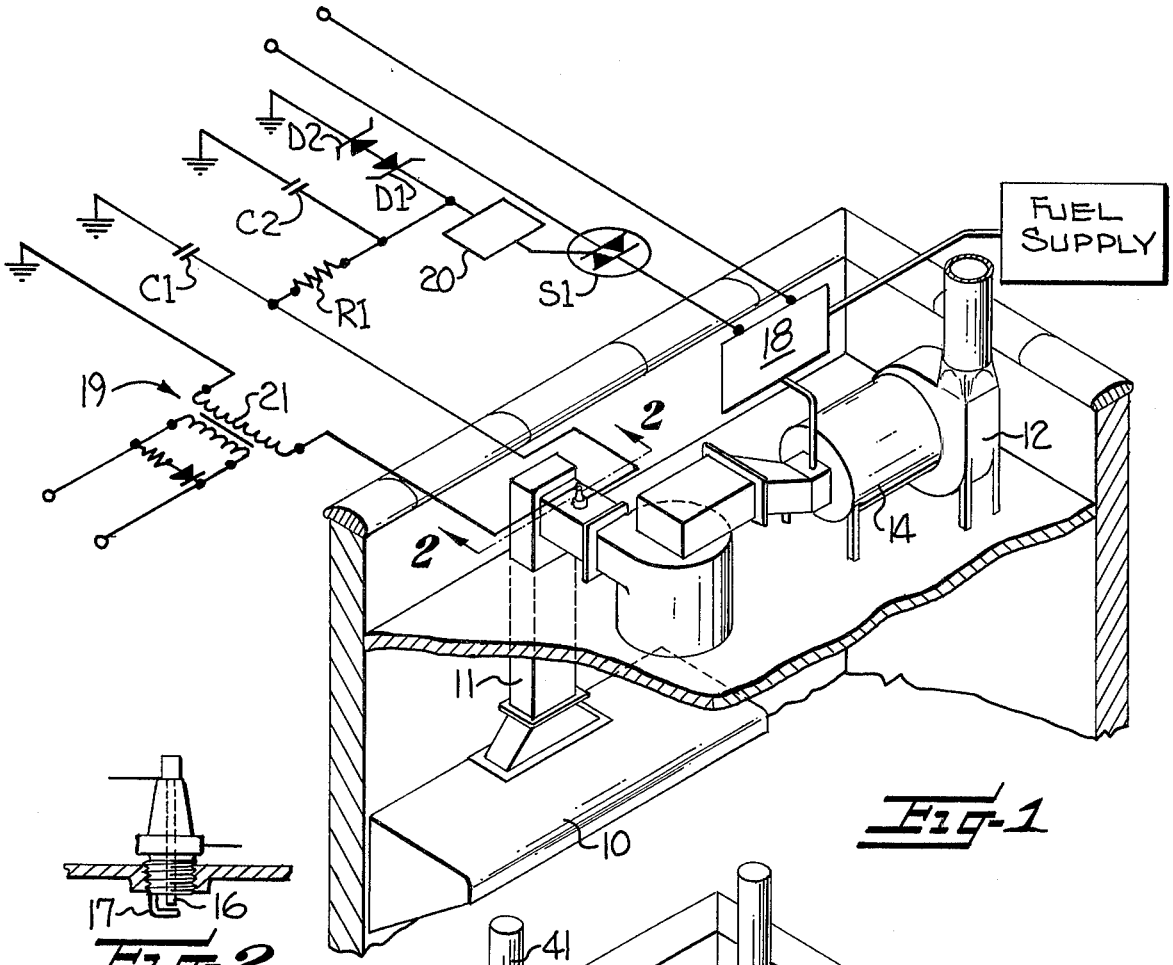
Fig-1
Fig-2
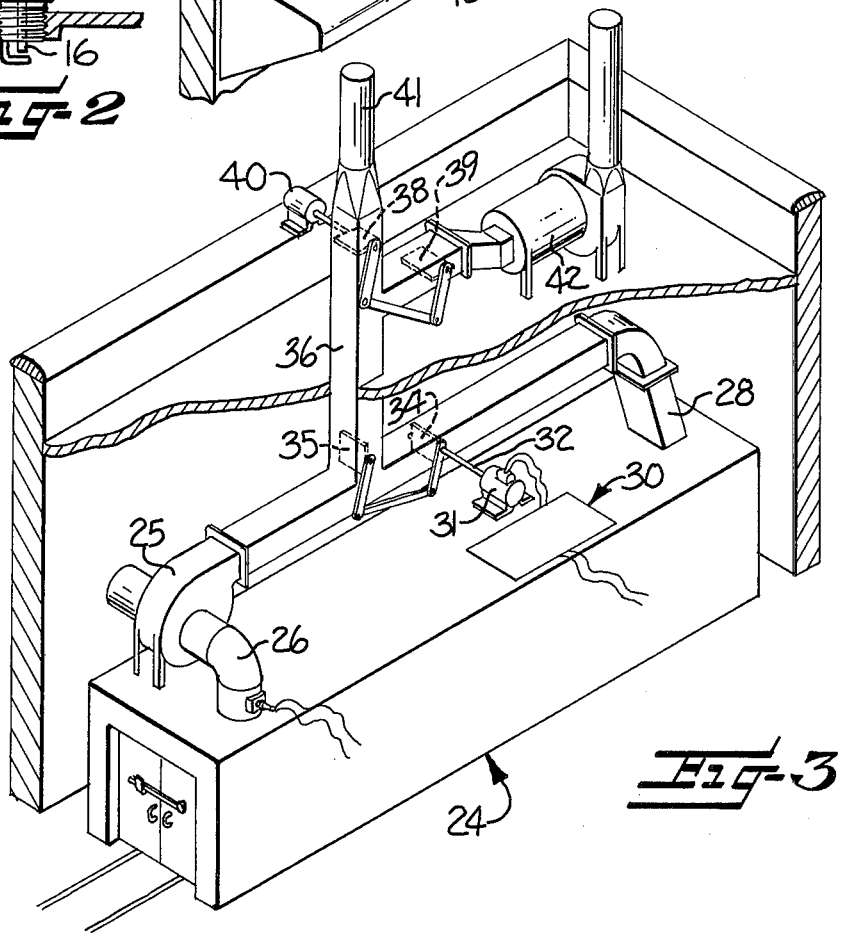
Fig-3

METHOD AND APPARATUS FOR SIGNALLING CONCENTRATION OF AIR CONVEYED IONIZABLE FOREIGN MATTER

Many processes involve the conveyance of ionizable foreign matter by an entraining air flow. By way of example, the ventilation of food preparation areas in fast service restaurants, process heating of industrial products, and occurrences of fire in residences and the like all involve the generation and conveyance of such foreign matter. More particularly, the operation of cooking apparatus such as charbroilers and the like generate airborne liquid particulate matter, largely grease, which is then entrained in a flow of air induced through an area encompassing the cooking apparatus. Drying of non-woven textile materials in an industrial oven exemplifies process heating circumstances in which ionizable foreign resins are driven from the textile materials and the like by elevated temperatures and conveyed by recirculating air flows which distribute heat within the oven. Again, combustion of household furnishings and the like during a fire emits ionizable foreign matter which is conveyed by entraining air flows from the site of combustion.

In each of the instances specifically mentioned, it has heretofore been proposed to detect the presence of such ionizable foreign matter for various control purposes. In the instance of food preparation area ventilation, detection of the presence of foreign matter may be employed to control the operation of a device such as an afterburner which disposes of airborne combustible debris. In the instance of industrial process heating ovens, detection of the presence of foreign matter may be employed to control blending or mixing of outside air with a recirculating air flow and diversion of portions of the recirculating air flow. In the instance of undesirable fires, detection of foreign matter is frequently employed to operate fire alarms and the like.

While a range of applications and possible devices are thus suggested, a common difficulty over the range of applications and devices arises from insensitivity of the detectors used to the degree of concentration of foreign matter and likely failure to detect the presence of such matter. More particularly, photoelectric detectors and the like have heretofore been proposed for use under each of the circumstances briefly reviewed hereinabove. In each such application, photoelectric detectors suffer deficiencies in that the paths by which such detectors are illuminated become partially or wholly obscured, destroying capability of the detector or, at the least, interferring with any capability for detecting a degree of concentration of foreign matter.

With the above in mind, it is an object of the present invention to signal the degree of concentration of ionizable foreign matter conveyed by an entraining air flow in such a manner as to avoid the deficiencies and shortcomings of previous arrangements. In realizing this object of the present invention, at least a portion of an air flow and conveyed matter entrained in the air flow are passed through an ionization detector spark gap while a continuous arcing electrical discharge is maintained across the gap. Such a continuous arcing electrical discharge is not subject to the difficulties of being obscured by accumulations of foreign matter and may be monitored to indicate fluctuations in the concentration of ionizable foreign matter.

A further object of this invention is to provide an apparatus in which a high voltage supply impresses voltage across a pair of spaced apart electrodes interposed in the flow path of an air flow and conveyed matter and the conductivity of a continuous arcing electrical discharge thereby established is monitored so as to indicate fluctuations in the concentration of ionizable foreign matter conveyed to the electrodes.

Yet a further object of this invention is to signal the degree of concentration of ionizable foreign matter conveyed by an entraining air flow and change a flow condition of the air flow and conveyed matter in response to a signalled increase in the concentration of ionizable foreign matter. In realizing this object of the present invention, air is sucked from an area and ionizable foreign matter from the area is entrained in the air flow. In response to a signalled increase in the degree of concentration of ionizable foreign matter conveyed from the area, the ionizable foreign matter is disposed of either by incineration or by diversion.

Some of the objects of the invention having been stated, other objects will appear as the description proceeds, when taken in connection with the accompanying drawing, in which:

FIG. 1 is a perspective view, partially schematic, of a first form of apparatus in accordance with this invention and including a schematic showing of electrical circuit means;

FIG. 2 is an enlarge elevation, partially in section, taken generally along the line 2—2 in FIG. 1 and showing an ionization detector spark gap used in accordance with the present invention; and FIG. 3 is a view similar to FIG. 1, showing a second form of apparatus in accordance with this invention.

Referring now more particularly to the accompanying drawing, FIGS. 1 and 3 illustrate the application of the method and apparatus of this invention to the conveyance of ionizable foreign matter from a food preparation area and from an enclosed process heating area. While these two environments of use of the present invention are instructive as providing exemplary applications, it is to be understood at the outset of the following description that the usefulness of the method and apparatus to be disclosed are contemplated as extending far beyond the specific applications illustrated. Thus, the description and accompanying illustrations are to be understood broadly as an enabling disclosure of the present invention, and not as restrictive upon this invention.

Persons familiar with certain prior arrangements for fast service restaurants and the like are aware that cooking apparatus such as charboilers (not shown) are frequently positioned in a food preparation area within a building. Suitable ventilation means, typically in the form of a hood 10 (FIG. 1) and communicating ductwork 11 are provided for defining a zone encompassing the cooking apparatus. By means of a fan 12 or the like operatively communicating with the hood 10 and duct 11, air is induced to flow through the zone below and adjacent the hood and combustible debris originating from the cooking apparatus is entrained in the air flow. It has heretofore been proposed that such combustible debris may be disposed of by an incineration in burner means such as an afterburner 14 to which fuel is supplied from an appropriate fuel supply as schematically indicated in FIG. 1.

In order to signal the degree of concentration of ionizable foreign matter conveyed by the entraining air flow through the hood 10 and duct 11, an ionization detector spark gap is provided through which at least a portion of the air flow and conveyed matter is passed. Preferably, the ionization detector spark gap bears a general resemblance to the spark plug of a spark ignition internal combustion engine, by having a pair of spaced apart and electrically insulated electrodes 16, 17 (FIG. 2). A continuous arching electrical discharge is maintained across the gap and the electrical conductivity of the discharge is monitored. By maintaining such a continuous discharge, fouling or other disturbance of the operation desired is avoided.

As will be appreciated, a flow of air in which no ionizable foreign matter is entrained or conveyed contains little available material to be oxidized and may be considered as a dielectric even when passing through the continuous arcing electrical discharge across ionization detector spark gap. The breakdown or arc-striking voltage of the spark gap depends upon the dielectric (or insulating) strength of air, the width of the gap, and the velocity of air flow through the gap. Considering only a gap of predetermined width in still air, the breakdown voltage of the gap is a function of the dielectric strength of the air in which the gap is immersed. Where ionizable foreign matter is introduced into the gap, the breakdown voltage is altered by virtue of the production of ions during electrical discharge through the ionizable foreign matter. Stated differently, a continuous arcing electrical discharge may be viewed as burning combustible foreign matter as such matter passes through the gap, thereby producing a mixture of air and combustion products which is much less dielectric than clean air and therefor requires much lower impressed voltage across the electrodes to maintain the continuous electrical arcing discharge.

In accordance with the present invention, such fluctuations in the conductivity of the continuous arcing electrical discharge are monitored as indicative of fluctuations in the degree of concentration of ionizable foreign matter passing through the ionization detector spark gap. As the degree of concentration of ionizable foreign matter increases, the magnitude of the voltage impressed on the spark gap decreases, giving rise to a control signal which may be employed for other and further purposes. In the particular context of the disposal of combustible debris conveyed from a food preparation area by an entraining air flow, a control means responsive to monitored concentrations of conveyed debris may increase the delivery of fuel to the burner means 14 with an increasing concentration of debris, so as to dispose of conveyed debris by incineration upon the concentration of such debris exceeding a determinable threshold. Such a control 18 is indicated schematically in FIG. 1 and may take the form of an electrically operated fuel valve which opens to admit fuel to a burner upon application of a line voltage thereto by electrical circuit means in accordance with this invention.

As schematically illustrated in FIG. 1, the electrical circuit means electrically connected with the electrodes 16, 17 forming the spark gap includes voltage supply means for impressing direct current high voltage across the electrodes. Preferably, the high voltage supply means includes a transformer 19 electrically connected for impressing voltage across the electrodes. Voltage detector means are electrically connected to one of the electrodes for continuously detecting the magnitude of the voltage of air compressed thereacross. As illustrated, the voltage detector means includes first and second capacitors C1, C2, a resistor R1 connected therebetween, reference diodes D1, D2, a semi-conductor line switch S1 preferably in the form of a Triac and voltage sensitive means generally indicated at 20 electrically connected between the gate of the semi-conductor switch S1 and the reference diodes D1, D2.

In operation, a secondary winding 21 of the transformer 19 is electrically connected to the other of the electrodes of the spark gap, to apply a fluctuating direct current thereto. The fluctuating direct current results from the use of a series resistor and diode connected across the primary winding of the transformer 19 and results in the accumulation of a charge on the capacitors C1, C2 sufficient to maintain the continuous arcing electrical discharge across the ionization detector spark gap as described herein. Where such continuous discharge is maintained, the residual voltage level present on the capacitors C1, C2 is indicative of the magnitude of the voltage impressed on the gap and thus the conductivity of the monitored discharge across the gap. By reference of such voltage against the reference diodes D1, D2, the voltage responsive means 20 governs triggering of the semi-conductor switch S1 as required for control functions such as are described herein.

In an operating embodiment of this invention, the transformer 19 was provided with a secondary winding capable of producing 6,000 volts alternating current at an output current of 22 milliamperes. It is contemplated that a suitable range of voltages and currents would encompass voltages in the range of from about 4,000 volts to about 8,000 volts and currents in the range of from about 15 milliamperes to about 30 milliamperes. The diode and resistor pair clipping the negative portions of the alternating current wave form applied to the primary winding of the transformer preferably has a diode rated for one ampere current at 200 volts PIV and a resistor rated at 225 ohms at one watt.

The DC filter and signal continuance network comprised of the capacitors C1, C2 and resistor R1 suitably uses capacitors rated for 400 microfarads at 250 volts direct current and a resistor rated at 225 ohms at one watt.

In an operating embodiment of this invention, the control means 20 is a schmidt trigger type device, commercially available under the name CALEX VOLT SENSOR. The schmidt trigger device responds to voltages in the range of about −15 volts direct current to +15 volts direct current and the input to the device is limited to that range by the diode pair D1, D2. The diode D1 preferably is a zener diode having a breakdown rating of 15 volts at 2 watts, while the diode D2 preferably is a similar diode having a breakdown rating of 14.4 volts at 2 watts.

The semi-conductor switch S1 may be any suitable device triggered by the output of the schmidt trigger device 20 so as to conduct alternating current. As will be noted, the semi-conductor switch S1 is inserted in one line voltage supply lead, to thereby control the application of line voltage to a control device such as a fuel valve.

The method of the present invention is applied to an industrial process heating oven in the embodiment of FIG. 3, where an enclosed process heating area is defined within an industrial oven generally indicated at 24. Means in the form of a fan 25 are provided for recirculating an air flow through a confined zone within the oven 24, by sucking air through a fan inlet conduit 26 and returning air into the oven through an oven inlet conduit 28. During process heating of industrial products within the oven 24, ionizable foreign matter is driven from the industrial products by heat, as is known to users of such ovens. Mounted in the fan inlet conduit is an ionization detector spark gap of the type described hereinabove with reference to FIGS. 1 and 2.

As will be understood, the electrical circuit means described with particularity in reference to FIG. 1 is employed in the arrangement of FIG. 3 for controlling diversion of air flow.

More particuarly, the semi-conductor switch (not shown in FIG. 3) conducts electrical current to a control device generally indicated at 30 which is electrically connected with a positioning motor 31 for governing the rotational position of an output shaft 32 thereof. The output shaft 32 is suitably connected with a pair of dampers 34, 35 positioned in the recirculation duct between the fan 25 and the oven inlet 28 and in a diversion duct 36 extending therefrom. As will be understood, the relative position of the shaft 32 of the positioning motor 31 will govern the extent to which air flow recirculated by the fan 25 is returned to the oven 24 or is diverted to exhaust.

It is to be noted that the arrangement of FIG. 3 is further provided with a second damper set 38, 39 controlled by a second positioning motor 40, in order to selectively direct the diverted air flow and conveyed matter to be vented to the ambient atmosphere through an exhaust stack 41 or to pass through an afterburner 42 for disposal by incineration. Persons familiar with such industrial processes will be aware of other separation or scrubbing operations which may similarly be performed to control emission of undesirable effluents or recycling for solvents and the like.

In the drawing and specification, there has been set forth a preferred embodiment of the invention, and although specific terms are employed, they are used in a generic and descriptive sense only and not for purposes of limitation.

That which is claimed is:

1. A method of signalling the degree of concentration of ionizable foreign matter conveyed by an entraining air flow and comprising inducing a flow of air through a zone while entraining ionizable foreign matter in the air flow and conveying the entrained matter from the zone, then passing at least a portion of the air flow and conveyed matter through an ionization detector spark gap while maintaining a continuous arcing electrical discharge across the gap, and monitoring the electrical conductivity of the discharge whereby fluctuations in the concentration of ionizable foreign matter conveyed from the zone are indicated by fluctuations in the monitored discharge conductivity.

2. A method according to claim 1 wherein the maintaining of the discharge comprises continuously impressing an electrical voltage across the gap and further wherein the monitoring of electrical conductivity comprises continuously detecting the magnitude of the voltage impressed on the gap.

3. A method according to claim 1 further comprising chaning a flow condition of the air flow and conveyed matter downstream of the gap in response to a signalled increase in the concentration of ionizable foreign matter.

4. A method according to claim 3 wherein the changing of a downstream flow condition comprises passing the air flow and conveyed matter through flame and incinerating the conveyed matter.

5. A method according to claim 3 wherein the changing of a downstream flow condition comprises dividing the air flow and conveyed matter between first and second flow paths while returning to the zone that portion flowing along one path and diverting that portion flowing along the other path.

6. A method according to claim 1 wherein the inducing air flow through a zone comprises sucking air from a food preparation area.

7. A method according to claim 1 wherein the inducing air flow through a zone comprises sucking air from an enclosed process heating area.

8. A method of signalling the degree of concentration of combustible debris conveyed by an entraining air flow and of disposing of such debris comprising inducing a flow of air through a zone encompassing a source of combustible debris while entraining debris in the air flow and conveying the entrained debris from the zone, then passing a portion of the air flow and conveyed debris through an ionization detector spark gap while maintaining a continuous arcing electrical discharge across the gap, monitoring the electrical conductivity of the discharge as indicative of the degree of concentration of conveyed debris, and passing the air flow and conveyed debris through a burner downstream of the gap while delivering fuel to the burner in response to monitored concentrations of conveyed debris which exceed a determinable threshold so as to dispose of conveyed debris by burning upon the concentration of such debris exceeding the threshold.

9. A method of signalling the degree of concentration of ionizable debris conveyed by a recirculating entraining air flow and of reducing such concentration comprising inducing a recirculating flow of air through a confined zone enclosing a source of ionizable debris while entraining ionizable debris in the air flow and conveying the entrained debris from the zone, then passing a portion of the air flow and conveyed debris through an ionization detector spark gap while maintaining a continuous arcing electrical discharge across the gap, monitoring the electrical conductivity of the discharge as indicative of the degree of concentration of conveyed debris, and diverting portions of the air flow and the debris conveyed thereby from recirculation through the zone in response to monitored concentrations of conveyed debris which exceed a determinable threshold so as to discharge conveyed debris from the zone upon the concentration of such debris exceeding the threshold.

10. Apparatus for signalling the degree of concentration of ionizable foreign matter conveyed by an air flow and comprising means for inducing a flow of air through a zone and along a predetermined flow path for entraining ionizable foreign matter and conveying the entrained matter from the zone, ionization detector spark gap means having spaced apart electrodes interposed in the flow path of the air flow and conveyed matter for passage of at least a portion of the air flow and conveyed matter between said electrodes, and electrical circuit means electrically connected with said electrodes for establishing and maintaining a continuous arcing electrical discharge between said electrodes and for monitoring the conductivity of the discharge whereby fluctuations in the concentration of ionizable foreign matter conveyed from the zone are indicated by fluctuations in the monitored discharge conductivity.

11. Apparatus according to claim 10 wherein said electrical circuit means comprises a direct current high voltage supply means for impressing a direct current voltage across said electrodes.

12. Apparatus according to claim 10 wherein said electrical circuit means comprises high voltage supply means for impressing voltage across said electrodes and voltage detector means electrically connected to one of said electrodes for continuously detecting the magnitude of the voltage impressed across said electrodes.

13. Apparatus according to claim 12 wherein said high voltage supply means comprises transformer means having a secondary winding electrically connected to the other of said electrodes.

14. Apparatus according to claim 10 further comprising means disposed downstream of said spark gap means and operatively responsive to said electrical circuit means for changing a flow condition of the air flow and conveyed matter in response to a signalled fluctuation in the concentration of ionizable foreign matter.

15. Apparatus according to claim 14 wherein said flow condition changing means comprises burner means for incinerating conveyed matter and fuel supply means operatively responsive to said electrical circuit means for increasing the flow of fuel to said burner means in response to a signalled increase in the concentration of ionizable foreign matter.

16. Apparatus according to claim 14 wherein said flow condition changing means comprises damper means for dividing the air flow and conveyed matter between first and second flow paths and for returning to said zone a portion flowing along one of said flow paths wile diverting that portion flowing along the other of said flow paths.

17. Apparatus for signalling the degree of concentration of ionizable foreign matter present in air and comprising ionization detector spark gap means having a pair of spaced apart electrodes for receiving between said electrodes air and airborne ionizable foreign matter, direct current high voltage supply means electrically connected with one of said electrodes for impressing thereon a positive voltage and for maintaining a continuous arcing electrical discharge between said electrodes, and voltage detector means electrically connected with the other of said electrodes for continuously detecting the magnitude of the voltage impressed across said electrodes and for monitoring the conductivity of the discharge therebetween whereby fluctuations in the concentration of ionizable foreign matter are indicated by fluctuations in the monitored discharge conductivity.

* * * * *